US006568927B1

(12) United States Patent
Guentert

(10) Patent No.: US 6,568,927 B1
(45) Date of Patent: May 27, 2003

(54) PISTON PUMP FOR HIGH-PRESSURE FUEL GENERATION

(75) Inventor: Josef Guentert, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/869,524

(22) PCT Filed: Nov. 16, 1999

(86) PCT No.: PCT/DE99/03643

§ 371 (c)(1),
(2), (4) Date: Sep. 10, 2001

(87) PCT Pub. No.: WO00/39450

PCT Pub. Date: Jul. 6, 2000

(30) Foreign Application Priority Data

Dec. 29, 1998 (DE) ..... 198 60 672

(51) Int. Cl.[7] ..... F04B 39/10; F04B 53/10
(52) U.S. Cl. ..... 417/569; 123/446
(58) Field of Search ..... 417/570, 569, 417/490, 273, 271; 123/446, 496, 447, 370, 449; 92/72; 239/96

(56) References Cited

U.S. PATENT DOCUMENTS 4,491,111 A * 1/1985 Eheim et al. ..... 123/449
4,884,542 A * 12/1989 Konrath et al. ..... 123/370
5,216,993 A * 6/1993 Knorreck et al. ..... 123/447
5,511,956 A * 4/1996 Hasegawa et al. ..... 417/271
5,884,606 A * 3/1999 Kellner et al. ..... 123/446
6,016,790 A * 1/2000 Makino et al. ..... 123/496
6,116,870 A * 9/2000 Kraemer ..... 417/490
6,253,734 B1 * 7/2001 Rembold et al. ..... 123/446
6,257,499 B1 * 7/2001 Sturman ..... 239/96
6,332,761 B1 * 12/2001 Guentert et al. ..... 417/490
6,347,574 B1 * 2/2002 Guentert et al. ..... 92/72
6,406,272 B2 * 6/2002 Ruthardt et al. ..... 417/273
6,450,788 B1 * 9/2002 Grabert ..... 417/570

* cited by examiner

*Primary Examiner*—Teresa Walberg
*Assistant Examiner*—Leonid M Fastovsky
(74) *Attorney, Agent, or Firm*—Ronald E. Greigg

(57) ABSTRACT

A high-pressure piston pump with a plurality of pump elements is connected on the intake side to a pump that pumps fuel at low pressure in a regulated quantity. Each pump element is preceded on the intake side by a first and a second check valve in series. The first check valve opens counter to spring force in the intake phase of the pump element and closes in the pumping phase. The second check valve opens counter to spring force and closes, reinforced by spring force, at pressures of the fuel supplied by the pump that are higher than the negative pressure generated in a cylinder chamber of the pump element. The second check valve takes on the metering of the fuel supplied to the pump element; the first check valve blocks off the cylinder chamber counter to the check valve in the pumping phase, whereby the piston pump serves to supply fuel at high pressure in fuel injection systems of internal combustion engines, especially in a common rail injection system.

5 Claims, 1 Drawing Sheet

PISTON PUMP FOR HIGH-PRESSURE FUEL GENERATION

CROSS-REFERENCE TO RELATED APPLICATIONS

This application is a 35 USC 371 application of PCT/DE 99/03643 filed on Nov. 16, 1999.

BACKGROUND OF THE INVENTION

1. Field of the Invention

The invention directed to a piston pump and more particularly to a piston pump for supplying high pressure fuel to a fuel injection is an internal combustion engine.

2. Description of the Prior Art

One such piston pump is known (German patent disclosure De 42 13 798 A1) that has three pump elements which are each connected on the intake side to a low-pressure supply, via a spring-loaded check valve. The known piston pump is by its design a constant pump, whose pump elements are set to a maximum required volumetric flow in a fuel injection system. In quantity regulation of the fuel flow on the low-pressure side, however, the disadvantage arises that at a volumetric flow smaller than the maximum volumetric flow, unequal filling of the various pump elements ensues because of variations in the check valves on the intake side. The reason for this is that the intake-side check valve of the pump elements set for a small opening stroke is opened during the intake stroke of the pump piston and during part of the pumping stroke. Overlaps in the opening times of the intake valves of other pump elements can occur. However, since at a small volumetric flow the pressure in the low-pressure system is quite low and decreases further upon filling of a pump element, if the opening time of one intake valve is too long, the result can be incomplete or entirely absent filling of another pump element. In the high-pressure part of the fuel injection system, however, this causes pressure fluctuations, which adversely affect the operation of the internal combustion engine connected to it.

From British Patent GB 564 725, a piston pump with two intake-side check valves connected in series is known. The check valves, which are structurally identical, have a ball that is not spring-loaded as their closing member, which assumes its closing position by gravity. With the dual disposition of the intake-side check valve, the intent is to achieve improved tightness and effectiveness of the pump.

SUMMARY OF THE INVENTION

The piston pump of the invention has the advantage over the prior art that the partial filling of a given pump element no longer depends essentially on the cooperation among the feed pressure of the feed pump, the spring force of the first check valve, and the negative pressure generated by the pump piston; instead, the duration of filling of the pump element is determined by the second check valve, which is essentially loaded only by feed pressure and spring force, and the second check valve also limits the filling when the volumetric flow of the supplied fuel is low, while the first check valve in the compression phase of the pumping process now serves essentially only to block off the cylinder chamber of the pump element from the second check valve. The fuel metering operation is thus no longer determined by the duration of opening of the first check valve. The onset and end of the metering operation are initiated and defined according to the invention by the feed pressure of the fuel.

BRIEF DESCRIPTION OF THE DRAWINGS

One exemplary embodiment of the invention is described in further detail herein below, taken in conjunction with the drawings, in which.

DESCRIPTION OF THE PREFERRED EMBODIMENT

Figure 1:
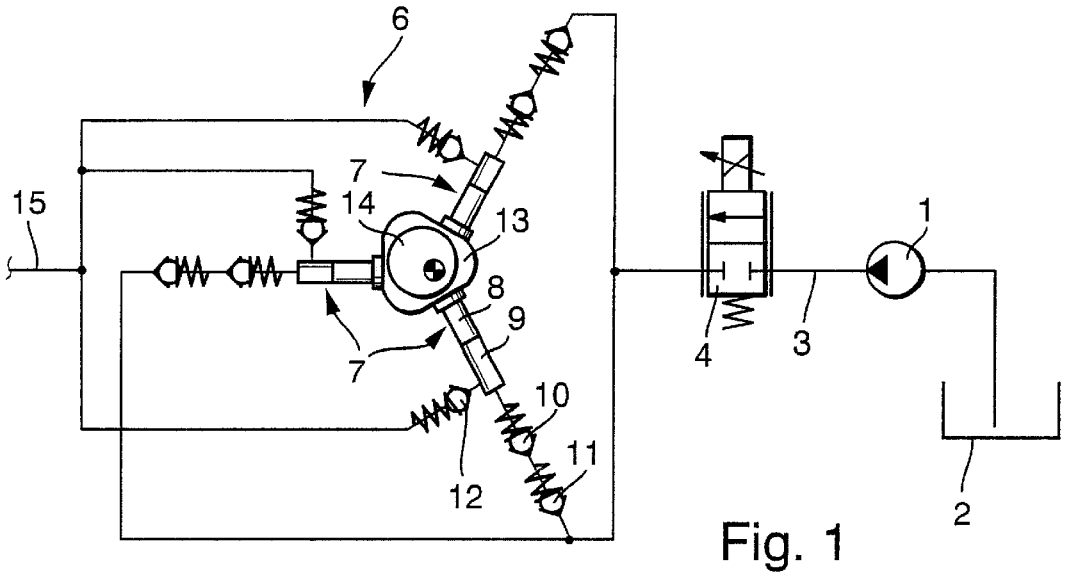
FIG. 1 shows a hydraulic circuit diagram of part of a fuel injection system having a piston pump for supplying fuel at high pressure to the system.

The hydraulic circuit diagram in FIG. 1 shows a pump assembly for generating high fuel pressure for a fuel injection system used in internal combustion engines, especially a common rail injection system. The pump assembly has a low-pressure feed pump 1, which on the intake side is connected to a fuel tank 2 that for instance contains Diesel fuel. On the compression side, a supply line 3 in which a flow regulating valve 4 is disposed extends from the feed pump The pump assembly furthermore has a high-pressure piston pump 6, with three pump elements 7; each pump element includes one pump piston 8 in a cylinder chamber 9, one first and one check valve 10 and 11 on the intake side, and one pressure valve 12 on the compression side. The pump pistons 8, disposed at an angular spacing of 120°, are braced by spring force on a stroke ring 13, which can be driven by an eccentric shaft 14.

The supply line 3 branches downstream of the flow regulating valve 4 and is connected to the second check valve 11 of each of the pump elements 7. The two check valves 10 and 11, opening in the direction of the cylinder chamber 9 counter to spring force, are connected in series, with the first check valve 10 located near the cylinder chamber in the applicable branch of the supply line. From the pressure valves 12 of the pump elements 7, line branches of a high-pressure fuel line 15 extend to a high-pressure fuel reservoir, or common rail, of the fuel injection system.

The low-pressure feed pump 1 and the high-pressure piston pump 6 are constant pumps. Consumption-dependent quantity regulation of the fuel flow from the feed pump 1 to the piston pump 6 is effected by means of the flow regulating valve 4. In the simplified hydraulic circuit diagram of FIG. 1, none of the pressure regulating and limiting valves, return lines, and fuel filters that all belong to the pump assembly are shown.

Figure 2:
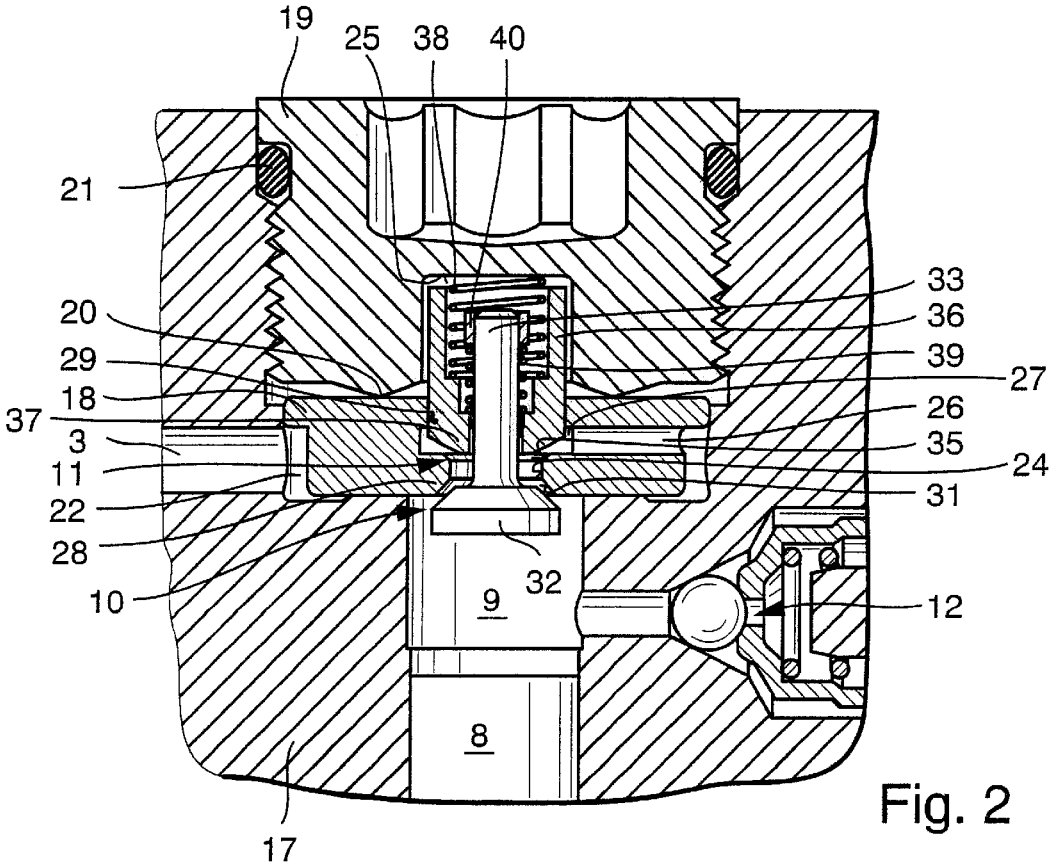
FIG. 2 is a section through a pump element of the piston pump.

In the longitudinal section through a pump element 7 shown in FIG. 2, a pump piston 8 can be seen in a cylinder chamber 9 of a housing 17. The pressure valve 12 of the pump element 7 is connected to the cylinder chamber 9. the cylinder chamber 9 is closed off by a valve plate 18 in the form of an annular disk. The valve plate is held down by a housing component 19, in the form of a closure screw that is screwed into the housing 17. The housing component 19, with a sealing edge 20, engages the side of the valve plate 18 remote from the cylinder chamber, and it is sealed off on its circumference from the housing 17 by a sealing ring 21. The valve plate 18 is surrounded on its circumference by an annular chamber 22, into which a line branch of the supply line 3 discharges.

The valve plate is provided with a graduated through bore 24 that extends coaxially to the cylinder chamber 9. A blind bore 25 is embodied in the housing component 19, coaxially with the through bore 24. The valve plate is furthermore provided with a radially extending branch conduit 26, which extends between the circumferential annular chamber 22 of the housing 10 and the graduated through bore 24. The branch conduit 26 discharges into a bore portion 27 of the through bore 24 that is located between an annular collar 28 toward the cylinder chamber and a bore portion 29 of the valve plate 18 remote from the cylinder chamber.

Toward the cylinder chamber, a hollow-conical valve seat 31 of the first check valve 10 is embodied on the annular collar 28 of the valve plate 18. This check valve has a platelike closing member 32, which is defined conically toward the valve seat 31. Because the cone angles differ from one another, the closing member 32 and the valve seat 31 touch along an edge whose diameter is at the same time the inside diameter of the annular collar 28. In a departure from the exemplary embodiment, it is also possible for the closing member 32 to be merely disk-shaped and to cooperated with the valve plate 18 by way of a flat valve seat 31. A shaft 33 extending from the closing member 32 penetrates the through bore 24 of the valve plate 18 with spacing and ends in the blind bore 25 of the housing component 20.

A hollow-conical valve seat 35 of the second check valve 11 is embodied on the side of the annular collar 28 remote from the cylinder chamber. A closing member 36 in the form of a sleeve is assigned to the second check valve, and its bottom 37 has a conical contour that cooperates with the valve seat 35. By suitably selected cone angles, the sealing diameter of the second check valve 11 matches the inside diameter of the annular collar 28. The sleevelike closing member 36 of the second check valve 11 is guided largely in pressure-tight fashion in the bore portion 29 of the valve plate 18 remote from the cylinder chamber, and it extends into the blind bore 25 of the housing component 19. Inside the blind bore 25, there is a prestressed compression spring 38, which is braced at one end, toward the bottom, on the closing member 36 and on the other on the bottom of the bore portion 25 on the housing component 19. The sleevelike closing member 36, with its bottom 37, surrounds the shaft 33 of the closing member 32 with radial play. A prestressed compression spring 39 is received on the shaft 33, on one end engaging the side of the sleeve bottom 27 remote from the cylinder chamber and on the other engaging a stop 40 on the closing member shaft. The two compression springs 38 and 39 each exert a closing force on the check valve 10 and 11, respectively, associated with them.

To explain the mode of operation of the two intake-side check valves 10 and 11, let it be assumed that the first check valve 10 is set for an opening pressure of 0.3 bar, and the second check valve 11 is set for an opening pressure of 1 bar. Let it also be assumed that both check valves 10 and 11 are in their closing position. The pressure of the fuel feed flow, pumped by the feed pump 1 and metered in quantity-regulated fashion by the flow regulating valve 4, prevails in the bore portion 27 of the through bore 24 in the valve plate 18 upstream of the closed second check valve 11. During the intake stroke of the pump piston 8, a negative pressure occurs in the cylinder chamber 9 and overcomes the spring force of the compression spring 39 and shifts the first check valve 10 into the open position (as shown). While the blind bore in the housing component 20 is pressure-relieved toward the cylinder chamber 9, the pressure of the fuel prevailing in the bore portion 27 of the through bore 24 of the valve plate 18 is exerted on a circular-annular effective area of the closing member 36 of the second check valve 11; this effective area is defined on one side by the sealing diameter of the valve seat 35 and on the other by the sealing diameter of the bore portion 29. If the pressure of the fuel exceeds the prestressing force of the compression spring 38 that is exerted on the closing member 36, then the second check valve 11 opens, and fuel flows into the cylinder chamber 9 of the pump element 7. The fuel pressure, which is dependent in its magnitude on the feed flow supplied, collapses upstream of the second check valve 11 during the filling operation, causing this check valve to shift from the open position, shown, to the closing position. The metering of the fuel quantity in the cylinder chamber 9 of the pump element 7 is thus effected by the second check valve 11. During the ensuing pumping phase of the pump piston 8, the pressure in the cylinder chamber 9 rises, and the first check valve 10 assumes its closing position. The second check valve 11, which functions in the opposite direction from the first check valve 10, is thus protected against being forced open by the fuel compressed by the pump piston 8. During the closing position of the second check valve 11, the pressure of the fuel pumped by the feed pump 1 increases again, and brings about the described valve function at the next pump element 7 to enter the intake phase. At the end of the pumping phase of the pump element 7, the pressure valve 12 opens, and the compressed fuel is expelled into the high-pressure line 15.

What is claimed is:

1. A piston pump (6) including a plurality of pump elements (7) for supplying fuel at high pressure in fuel injection systems of internal combustion engines, in particular in a common rail injection system, wherein the pump elements (7) are connected on the intake side to a pump (1) that pumps fuel at low pressure in a regulated quantity, each pump element (7) is preceded on the intake side by a first check valve (10), with which the supply of fuel into a cylinder chamber (9) of the pump element (7), which chamber has a pump piston (8), is controllable, the first check valve (10) opens counter to spring force in the intake phase of the pump element (7) and closes in the pumping phase, and wherein a second check valve (11) precedes the first check valve (11) on the inflow side; and the second check valve (11) opens counter to spring force and closes, reinforced by spring force, at pressures of the fuel supplied by the pump (1) that are higher than the negative pressure generated in a cylinder chamber (9) of the pump element (7).

2. The piston pump of claim 1, wherein a valve plate (18) adjoining the cylinder chamber (9) is provided;

a graduated through bore (24) is embodied in the valve plate (18);

on an annular collar (28) of the through bore (24), a first valve seat (31) for the engagement of a closing member (32) of the first check valve (10) is embodied on the side toward the cylinder chamber, and on the side remote from the cylinder chamber, a second valve seat is embodied for the engagement of a closing member (36) of the second check valve (11);

in the valve plate (18), on the side remote from the cylinder chamber, the closing member (36) of the second check valve (11) is guided longitudinally displaceably, in largely pressure-tight fashion, in the through bore (24), and the diameter of the guiding bore portion (29) is greater than the sealing diameter of the associated valve seat (35);

fuel is pumped by the feed pump (1) into a bore portion (27) of the through bore (24) that is located between the valve seat (35) of the second check valve (11) and the guiding bore portion (29).

3. The piston pump of claim 1, wherein closing member (36) of the second check valve (11) takes the form of a sleeve, whose bottom (37) that engages the associated valve seat (35) is penetrated coaxially with play by a shaft (33) of the closing member (32) of the first check valve (10).

4. The piston pump of claim 3, wherein the closing member (35) of the second check valve (11) is braced, remote from the cylinder chamber, by a prestressed compression spring (38) against a housing component (19) of the pump element (7).

5. The piston pump of claim 3, wherein a prestressed compression spring (39) is received on the shaft (33) of the closing member (32) of the first check valve (10), on one side engaging the side of the sleeve bottom (37) of the second check valve (11) remote from the cylinder chamber and on the other engaging a stop (40) on the closing member shaft (33).

* * * * *